US007805093B2

(12) United States Patent
Yoshino

(10) Patent No.: US 7,805,093 B2
(45) Date of Patent: Sep. 28, 2010

(54) PROCESS CARTRIDGE AND ELECTROPHOTOGRAPHIC IMAGE FORMING APPARATUS USABLE THEREWITH

(75) Inventor: Yasufumi Yoshino, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 771 days.

(21) Appl. No.: 11/681,480

(22) Filed: Mar. 2, 2007

(65) Prior Publication Data

US 2007/0206971 A1 Sep. 6, 2007

(30) Foreign Application Priority Data

Mar. 3, 2006 (JP) ..... 2006-057624

(51) Int. Cl.
*G03G 21/16* (2006.01)

(52) U.S. Cl. ..... 399/111; 399/113; 399/114

(58) Field of Classification Search ..... 399/113, 399/114

See application file for complete search history.

(56) References Cited

U.S. PATENT DOCUMENTS

| | | | | |
|---|---|---|---|---|
| 6,782,219 | B2 | 8/2004 | Yoshino et al. | 399/90 |
| 6,978,100 | B2 | 12/2005 | Yasui et al. | 399/103 |
| 7,068,965 | B2 | 6/2006 | Yoshino et al. | 399/119 |
| 7,155,137 | B2 | 12/2006 | Yasui et al. | 399/103 |
| 7,194,225 | B2 * | 3/2007 | Yamaguchi | 399/111 |
| 7,319,834 | B2 * | 1/2008 | Yamaguchi | 399/111 |
| 7,477,865 | B2 * | 1/2009 | Yamaguchi | 399/111 |
| 2005/0025522 | A1 * | 2/2005 | Tsuzuki et al. | 399/111 |
| 2007/0071495 | A1 * | 3/2007 | Hashimoto et al. | 399/111 |

FOREIGN PATENT DOCUMENTS

| | | |
|---|---|---|
| JP | 5-232752 | 9/1993 |
| JP | 11-130146 | 5/1999 |
| JP | 2001-282079 | 10/2001 |
| JP | 2001-337511 | 12/2001 |
| JP | 2002-006722 | 1/2002 |

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

A process cartridge is detachably mountable to a main assembly of an electrophotographic image forming apparatus. The apparatus includes an electrophotographic photosensitive member, a developing roller, two units, a movable member, and a cover. The roller can contact the photosensitive member to develop an image formed thereon. One unit supports the photosensitive member with a part thereof exposed. The other unit supports the roller and moves between positions for contacting the roller and the photosensitive member with each other and spacing these elements from each other. The movable member moves the roller-supporting unit between the contact and spaced positions. The cover covers the exposed part and engages the movable member to regulate movement thereof with the developing unit positioned in the spaced position.

18 Claims, 7 Drawing Sheets

(a)

(b)

PROCESS CARTRIDGE AND ELECTROPHOTOGRAPHIC IMAGE FORMING APPARATUS USABLE THEREWITH

FIELD OF THE INVENTION AND RELATED ART

The present invention relates to a process cartridge and an electrophotographic image forming apparatus to which the process cartridge is detachably mountable which forms an image on a recording material.

Here, the electrophotographic image forming apparatus forms the image on the recording material (for example, plain paper, or an OHP sheet) using an electrophotographic image-formation-type process. Examples of the electrophotographic image forming apparatus, include an electrophotographic copying apparatus, an electrophotographic printers (for example, a laser beam printer, a LED printer, etc.), a facsimile machine, a word processor, etc.

The process cartridge is a unit into which an electrophotographic photosensitive member and at least a developing device are unified and which is detachably mountable to the main assembly of the image forming apparatus.

Heretofore, a contact type developing system is known as one of the developing systems used with the electrophotographic image forming apparatus. The contact type developing system is the type which develops the electrostatic latent image formed on the photosensitive drum using a developer with the developing roller and the photosensitive drum contacted to each other. In a contact type developing system, when they are unused in the state in which a developing roller and the photosensitive drum are contacted with each other for a long time, there is a possibility that the developing roller may deform.

In order to solve such a problem, it is known that except for the time of the image formation, the developing roller and the photosensitive drum are spaced from each other (Japanese Laid-open Patent Application 2001-337511).

Here, in the above described structure, a trigger for spacing the developing roller and the photosensitive drum from each other is provided in a main assembly of the electrophotographic image forming apparatus (henceforth simply "the main assembly of the apparatus"). The developing roller and the photosensitive drum are provided in an image formation unit. The image formation unit is detachably mountable to the main assembly of the apparatus. The image formation unit has the developing unit which supports the developing roller rotatably, and the drum unit which supports the photosensitive drum rotatably. In the state where image formation unit is set to the main assembly of the apparatus, the trigger presses the developing unit during the time of non-image formation. By this, the developing unit moves relative to the drum unit. As a result, the developing roller and the photosensitive drum can be spaced from each other.

In another known structure, a spacer is provided on the protecting cover for the photosensitive drum, and the spacer is inserted between the developing roller unit and the photosensitive drum unit, to thereby space the developing roller from the photosensitive drum at the time of process cartridge being not used (Japanese Laid-open Patent Application Hei 5-232752).

However, also in such a structure, it is necessary to space the developing roller and the photosensitive drum from each other assuredly in the state where image formation unit is not set to the main assembly of the apparatus.

SUMMARY OF THE INVENTION

Accordingly, it is a principal object of the present invention is to provide a process cartridge and an electrophotographic image forming apparatus which can retain the spacing between a developing roller and a photosensitive drum assuredly.

DETAILED DESCRIPTION OF THE PREFERRED EMBODIMENTS

The process cartridge and the electrophotographic image forming apparatus according to the present invention are described in detail in conjunction with the drawings.

Figure 1:
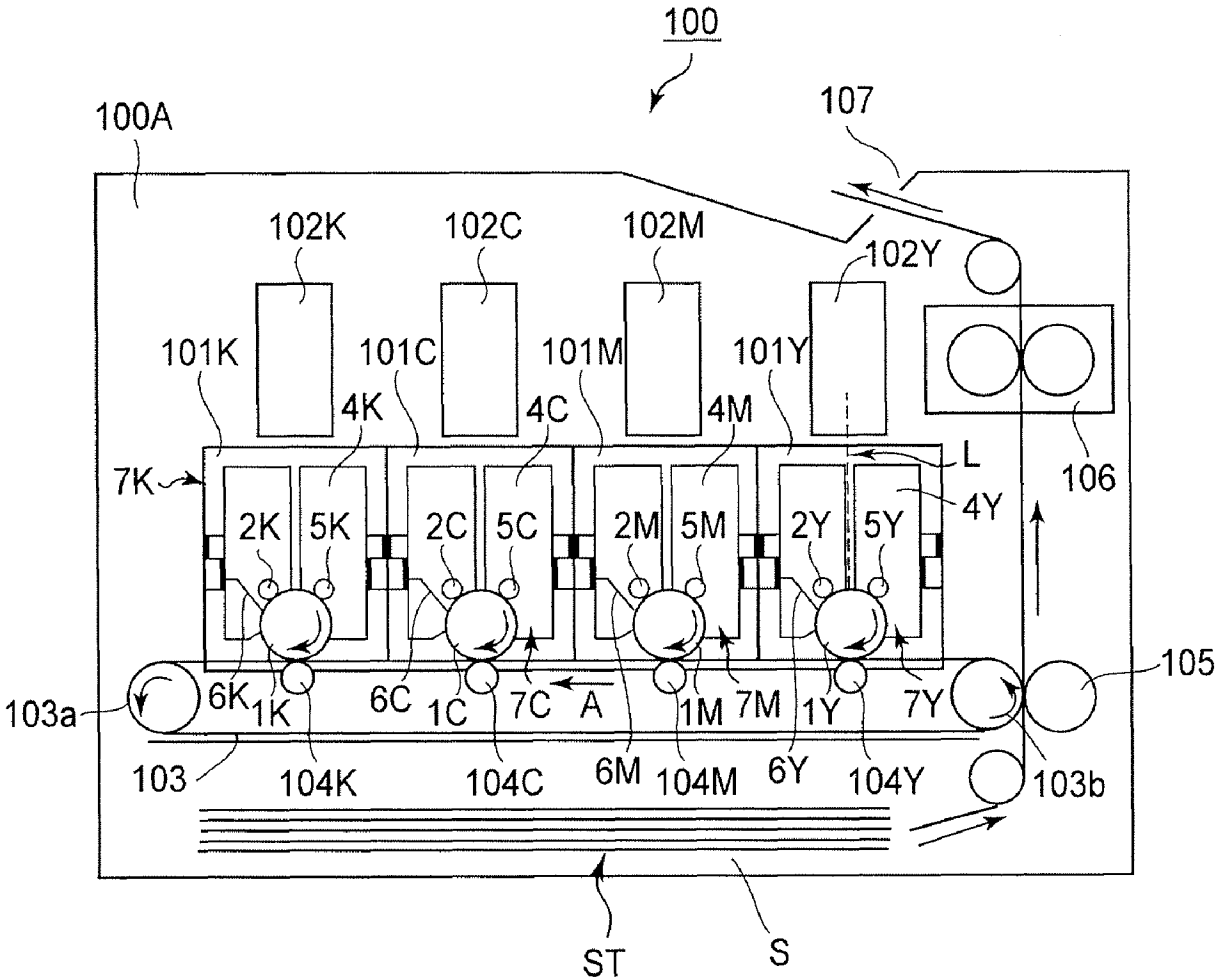
FIG. 1 is a sectional view schematically illustrating a general arrangement of an electrophotographic image forming apparatus according to an embodiment of the present invention.

In the first embodiment, the electrophotographic image forming apparatus is a color laser beam printer of the electrophotographic type. FIG. 1 shows a general arrangement of the color laser beam printer provided with the process cartridge of this embodiment.

(Structure of Electrophotographic Image Forming Apparatus)

First, referring to FIG. 1, the structure of electrophotographic image forming apparatus 100 to which the process cartridge 7 (7Y, 7M, 7C, 7K) is detachably mountable in this embodiment will be described.

The main assembly 100A of the electrophotographic image forming apparatus 100 comprises four cartridge mounting portions (101Y, 101M, 101C, 101K), in order to receive cartridges 7 (7Y, 7M, 7C, 7K). Where the main assembly 100A of the apparatus is installed, each mounting portion is juxtaposed horizontally.

Each cartridge 7 (7Y, 7M, 7C, 7Bk) has an electrophotographic photosensitive member (henceforth "photosensitive drum") 1 (1Y, 1M, 1C, 1K) in the form of a drum as the image bearing member. Cartridges 7 are located in a line from the upstream side toward the downstream side in order of cartridges 7Y, 7M, 7C, and 7K with respect to the direction of the image formation (the direction shown by arrow A in FIG. 1, and a traveling direction of an image transfer belt 103).

Figure 3:
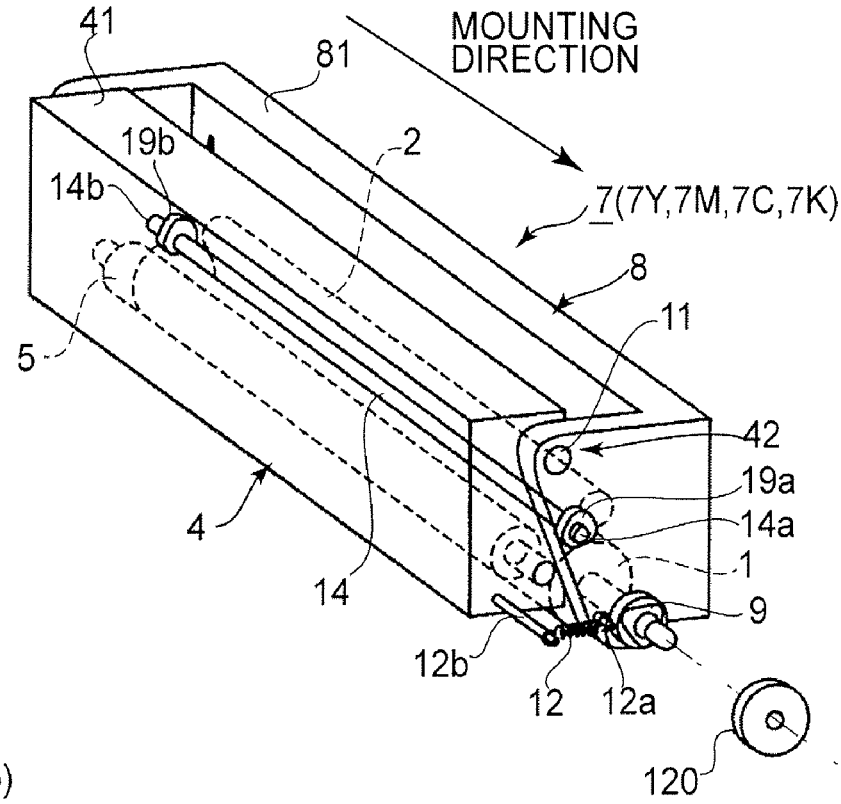
FIGS. 3(*a*) and 3(*b*) are perspective views of the outer appearance illustrating a process cartridge according to an embodiment of the present invention.
Figure 3:
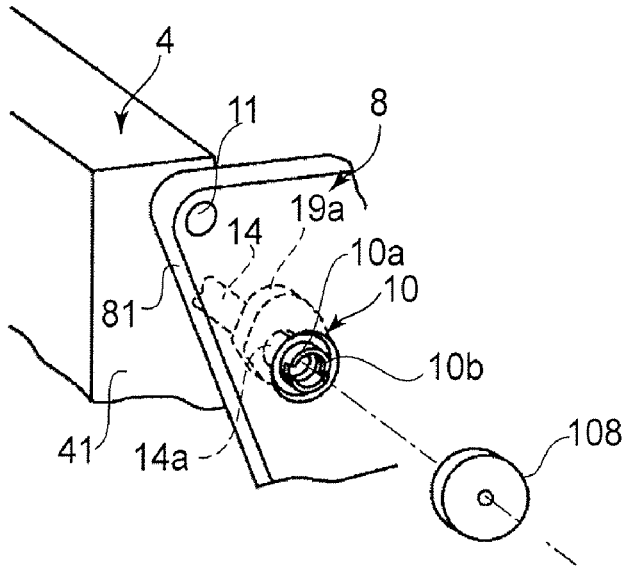

The photosensitive drum 1 is rotated clockwise by connecting with a drive transmitting portion 120 (FIG. 3 (*a*)) provided in the main assembly of the apparatus 100A.

A charging roller 2 (2Y, 2M, 2C, 2K), a scanner unit (102Y, 102M, 102C, 102K), and a developing unit 4 (4Y, 4M, 4C, 4K) are disposed in the order named in the rotational direction around the photosensitive drum 1. The transfer belt 103 as the intermediary transfer member is disposed under the photosensitive drum 1 (1Y, 1M, 1C, 1K). The transfer belt 103 is stretched between supporting rollers 103*a* and 103*b*, and is rotated in the direction of an arrow A.

Here, the charging roller 2 charges the peripheral surface of the photosensitive drum 1 uniformly in contact with the photosensitive drum 1. The scanner unit irradiates the peripheral surface of the photosensitive drum 1 with the laser beam L on the basis of the image information. As a result, an electrostatic latent image corresponding to the image information is formed on the peripheral surface of the photosensitive drum 1.

Figure 5:
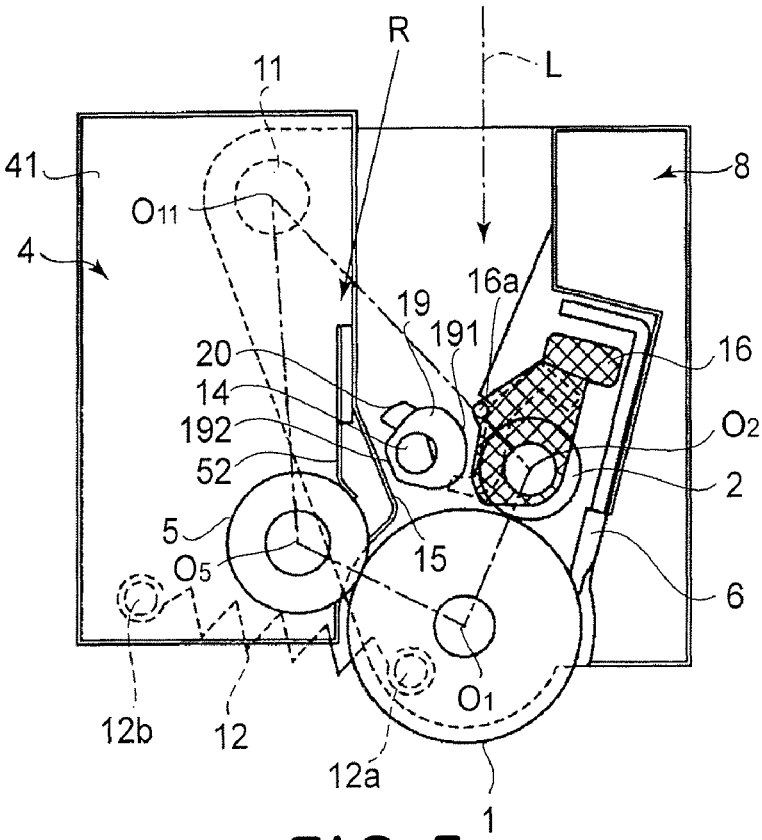
FIG. 5 is a sectional view, at the time of the image formation, of the process cartridge according to the embodiment of the present invention.

As will better be understood also from FIG. 5, in the developing unit 4 (4Y, 4M, 4C, 4K), the developing unit frame 41 constitutes a developer container containing the developer. The developing units 4Y, 4M, 4C, 4K contain yellow (Y), magenta (M), cyan (C) and black (K) developers, respectively. In this embodiment, the developer is non-magnetic one-component toner. Hereinafter, the developer is called "toner."

The developing unit frame 41, i.e., the developer container, supports a developing roller 5 (5Y, 5M, 5C, 5K) as a developer carrying member rotatably, and, further in this embodiment, it is provided with a developing blade 52 for regulating a layer thickness of the developer on the surface of the developing roller 5.

The developing roller 5 develops the electrostatic latent image formed on each photosensitive drum using the developer to provide the developer image (the toner image).

As has been described hereinbefore, a transfer belt 103 is disposed under each photosensitive drum 1. A primary transfer roller (104Y, 104M, 104C, 104K) as primary transfer means is provided at the position opposing the photosensitive drum 1 interposing the rotating transfer belt 103 therebetween. The primary transfer roller presses the transfer belt 103 against the photosensitive drum 1. Therefore, the transfer belt 103 is rotated in contact with the photosensitive drum 1 (1Y, 1M, 1C, 1K).

In the above described structure, the developer image (the toner image) formed on each photosensitive drum 1 is transferred electrostatically to the transfer belt 103 with the primary transfer roller (104Y, 104M, 104C, 104K). The secondary transfer roller 105 as the secondary transfer means is disposed at the righthand side of the transfer belt 103 opposed to the supporting roller 103*b* in FIG. 1. The recording material S fed from a sheet feeder ST passes the contact portion (secondary transferring position) between the transfer belt 103 and the secondary transfer roller 105. In the secondary transferring position, the toner image is transferred onto the recording material S from the transfer belt 103.

The developer which remains on the peripheral surface of the photosensitive drum 1 peripheral surface after the transferring is removed by the cleaning means 6 (6Y, 6M, 6C, 6K).

In this embodiment, the photosensitive drum 1, the charging roller 2, the developing unit 4, and the cleaning means 6 are unified into a cartridge integrally, and constitute the process cartridge 7.

The operation of the image formation in the image formation apparatus of the above described structure will be described.

First, the photosensitive drum 1 provided in each cartridge 7 is rotated in timed relation with the image formation by a drive transmitting portion 120 provided in the main assembly 100A of the apparatus 100.

In this embodiment, the photosensitive drum 1 and the developing roller 5 are spaced from each other before the image formation. The developing roller 5 is contacted to the photosensitive drum 1, rotating in accordance with the timing of the image formation.

When full color image formation is started, a contacting operation between the developing roller 5 and the photosensitive drum 1 is performed in the order of the cartridge 7Y, the cartridge 7M, the cartridge 7C, and the cartridge 7K. When the full color image formation is finished, spacing operation between the developing roller 5 and the photosensitive drum 1 is performed in the above described order.

In forming a monochrome image, at the time of the start of image formation, only in the cartridge 7K, the developing roller 5 and the photosensitive drum 1K contact to each other, and after the image formation finishes, the developing roller 5 and the photosensitive drum 1 are spaced from each other.

Subsequently, the scanner unit correspondingly to each cartridge 7 starts. And, the charging roller 2 is rotated by being driven by the rotation of the photosensitive drum 1. In that case, a charging bias voltage is applied to the charging roller 2. As a result, the uniform charge is applied to the peripheral surface of the photosensitive drum 1.

The scanner unit irradiates the peripheral surface of the charged photosensitive drum 1 with the laser beam L correspondingly to the image information. As a result, the electrostatic latent image is formed on the peripheral surface of the photosensitive drum 1.

Subsequently, the developing roller 5 rotatably supported by the developing unit 4 develops the electrostatic latent image into a visual image, i.e., the toner image, using the developer.

The toner image formed on each photosensitive drum 1 is transferred onto the transfer belt 103 sequentially by the electric field formed between each photosensitive drum 1 and an associated primary transfer roller 104. Then, the toner image of the four colors having been transferred onto the transfer belt 103 is transferred onto the recording material S as the recording material passes between the transfer belt 103 and the secondary transfer roller 105.

Thereafter, the recording material S is fed to a fixing station 106, and the toner image is heat-fixed on the recording material S in the fixing station 106. The heat-fixed recording material S is discharged out of the image formation apparatus 100 from the discharging portion 107.

(Mounting of Process Cartridge to Main Assembly of Electrophotographic Image Forming Apparatus)

Figure 2:
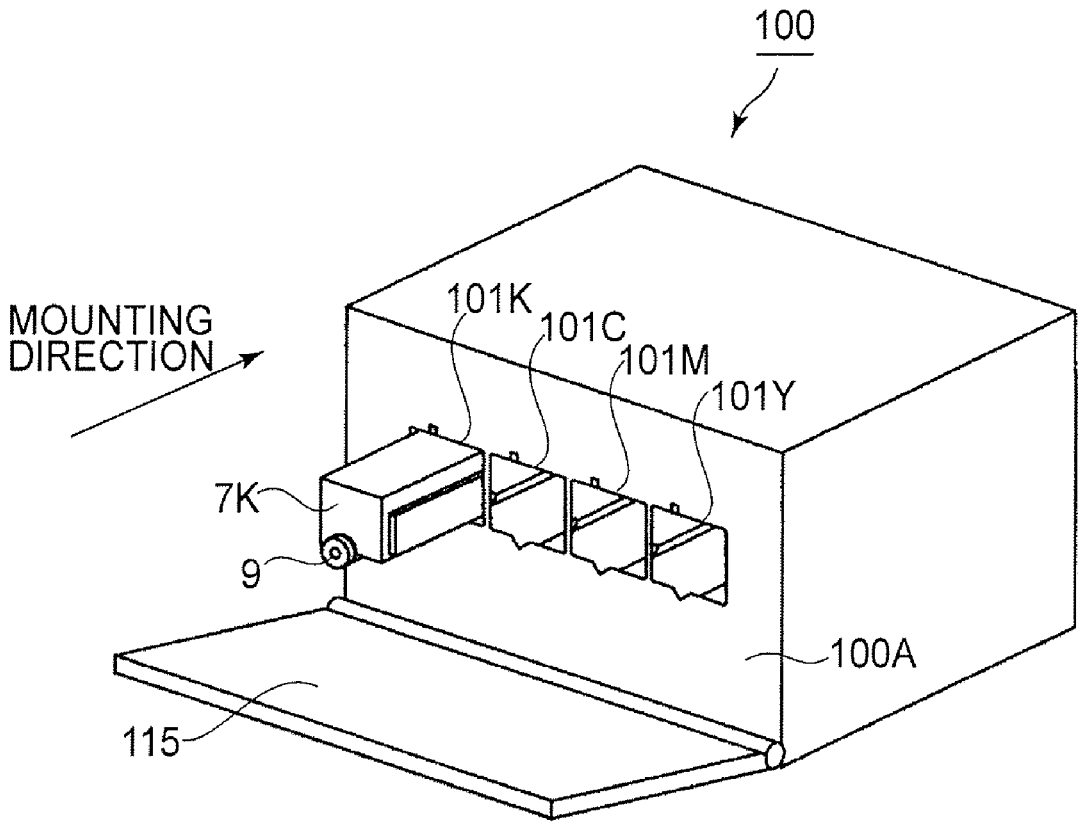
FIG. 2 is a perspective view of the electrophotographic image forming apparatus.

Referring to FIGS. 2 and 3, the mounting of the process cartridge 7 to the main assembly of the apparatus 100A will be described.

As illustrated, a main assembly door 115 is provided in the front side of the main assembly 100A of the apparatus 100, and the cartridge mounting portion (101Y, 101M, 101C, 101K) for setting the cartridge 7 is disposed inside of the main assembly door 115.

Although only the cartridge 7K is illustrated in FIG. 2, each cartridge 7 (7Y, 7M, 7C, 7K) is mounted to the mounting portion (101Y, 101M, 101C, 101K) which corresponds to the same direction as a longitudinal direction of the cartridge 7, in other words, the longitudinal directions of the photosensitive drum 1 and the developing roller 5.

(Process Cartridge)

The process cartridge 7 (7Y, 7M, 7C, 7K) will be described. The cartridges 7Y, 7M, 7C, 7K have the same structure. FIG. 3 (*a*) is a perspective view of the cartridge 7, and FIG. 3 (*b*) is a partly enlarged perspective view of the cartridge 7.

In this embodiment, the cartridge 7 includes the drum unit 8 and the developing unit 4. The drum unit 8 includes the photosensitive drum 1, the charging roller 2, and the cleaning means 6. The photosensitive drum 1 and the charging roller 2 are rotatably supported on the drum unit 8. On the other hand, as has been described hereinbefore, the developing roller 5 is rotatably supported on the developing unit 4.

A supporting portion 42 for rotatably supporting the developing unit 4 is provided at each of the opposite ends of the drum unit 8, and the drum unit 8 supports the developing unit 4 swingably by way of the pivot pin 11 provided in the supporting portion 42. In other words, the developing unit 4 is movable relative to the drum unit 8. In other words, again, the developing unit 4 and the drum unit 8 are rotatably connected with the pivot pin 11 of the supporting portion 42.

As will better be understood also from FIG. 5, the cartridge 7 includes the spring 12 as an urging member for applying an urging force (the elastic force) between the drum unit 8 and the developing unit 4. One end of the spring 12 is mounted to a pin 12*a* provided in the drum unit 8, and the other end is mounted to a pin 12*b* provided in the developing unit 4. Therefore, the developing roller 5 and the photosensitive drum 1 are contacted to each other by the urging force of the spring 12. Although the urging member is in this embodiment a spring, as long as it can apply the urging force between the units 4 and 8, it may be other than a spring.

In this embodiment, the developing unit 4 is urged in the counterclockwise rotation about the supporting shaft 11 by the spring 12 in FIG. 5. By this, the developing roller 5 is kept contacted to the photosensitive drum 1.

Figure 4:
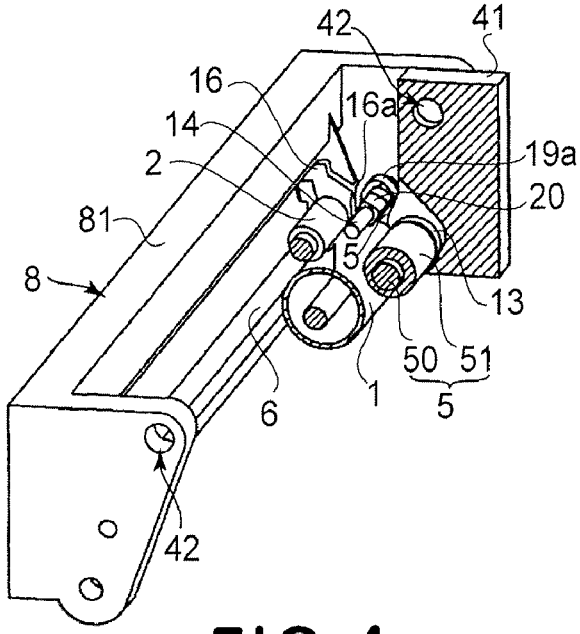
FIG. 4 is a sectional perspective view of the process cartridge according to the embodiment of the present invention.

FIG. 4 is a view of the cartridge 7 as seen from the inside, wherein for better understanding, the developing unit 4 and the photosensitive drum 1 are partly broken so that the internal structure of the cartridge 7 may be easy to understand.

FIG. 4 shows the one end with respect to the longitudinal direction of the cartridge 7, and the other end of the longitudinal direction is constituted similarly. As has been described hereinbefore, in this embodiment, the structure of each cartridge 7 is the same, other than the color of the developer contained in the developing unit frame 41, i.e., the developer container.

In this embodiment, the developing roller 5 has a metal shaft 50, and the peripheral surface thereof is coated with an elastic member 51. A roller 13 of a cylindrical shape is rotatably provided at the opposite end portions of the metal shaft 50. The outer diameter of the roller 13 is slightly smaller than the outer diameter of the developing roller 5. And, the roller 13 is contacted to the peripheral surface of the photosensitive drum 1 at the time of the image formation. By this, an amount of entering relative to the elastic member 51 of the photosensitive drum 1 is regulated by the desired value.

Figure 6:
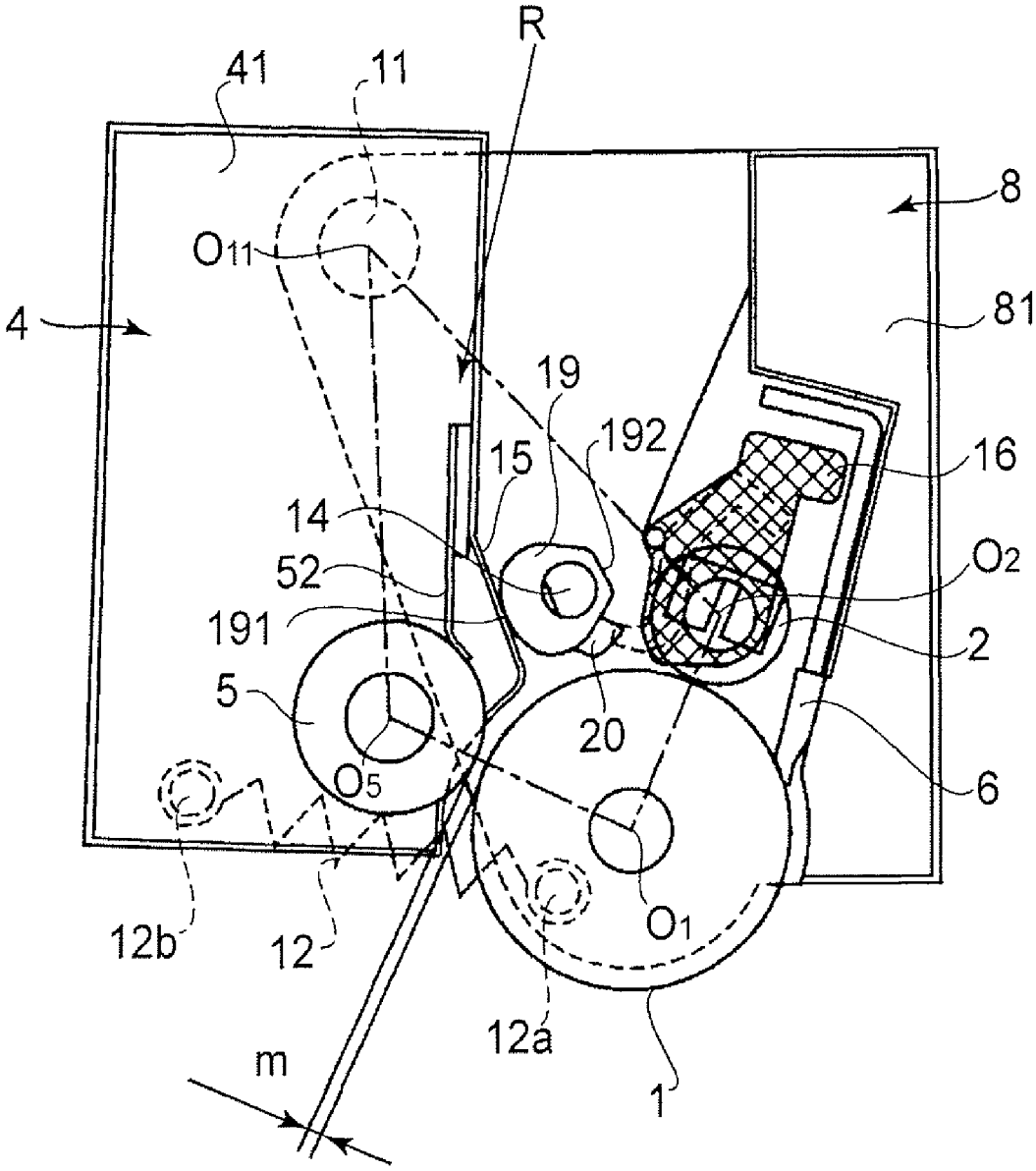
FIG. 6 is a sectional view, at the time of the non-image formation, of the process cartridge according to an embodiment of the present invention.

As will better be understood also from FIG. 3, FIG. 5, and FIG. 6, between the developing unit 4 and the drum unit 8, there are provided a cam 19 (19*a* and 19*b*) and a moving member supporting shaft (henceforth the "cam shaft") 14 as the moving member for moving the developing unit 4 relative to the drum unit 8. As shown in FIG. 3, the cam 19 is mounted on the opposite ends of the cam shaft 14. More specifically, the cam 19 is provided between the developing roller 5 and the charging roller 2 as seen along the mounting direction of the cartridge 7 shown in FIG. 3.

Further specifically, as seen along the mounting direction in FIG. 5 and FIG. 6, the cam 19 is disposed in the area defined by the axis O5 of the developing roller 5, the axis O2 of the charging roller 2, the axis O1 of the photosensitive drum 1, and the axis O11 of the pivot pin 11 between the drum unit 8 and the developing unit 4 (the region R surrounded by the chain lines in FIG. 5 and FIG. 6).

By doing so, it is not necessary to additionally provide a space for disposing the cam 19. Therefore, the downsizing of the cartridge 7 can be accomplished and, by this, the downsizing of the main assembly 100A of the apparatus 100 can be accomplished.

As has been described hereinbefore, the above described cam shaft 14 constituting the moving member shown in FIG. 3 is provided in the drum unit 8 in parallel with the photosensitive drum 1. The cam shaft 14 is extended from the one end of the drum unit 8 to the other end along the longitudinal direction of the drum unit 8. The cam 19 is provided on each of said one end 14*a* and the other end 14*b* with respect to the longitudinal direction of the cam shaft 14.

The opposite longitudinal ends 14*a*, 14*b* of the cam shaft 14 are rotatably supported on the frame 81 of the drum unit 8. More specifically, in the longitudinal direction of the cam shaft 14, the outside end portion 14*a*, 14*b* beyond the cam 19 is supported on the drum unit frame 81. In other words, the cam 19 is provided inside of the frame 81 with respect to the longitudinal direction. The downsizing of the cartridge 7 can be accomplished by disposing the cam 19 in this manner.

The laser beam L projected from the scanner unit passes between the charging roller 2 and the cam shafts 14 (FIG. 5).

The cam 19 is opposed to the surface-to-be-urged 15, i.e., the surface to be acted by the cam, also known as the cam-acting surface provided on each of the side surfaces of the developing unit 4 at the opposite end portions, with respect to the longitudinal direction, of the developing unit frame 41.

On the cam shaft 14, a projection 20 is provided as a second cam. The projection 20 is mounted to the cam shaft 14 at a position nearer to the center portion from the cam 19 with respect to the longitudinal direction of the shaft 14. The projection 20 has a function to release the charging roller 2 from contact with the photosensitive drum 1.

The charging roller 2 is rotatably mounted to the supporting member 16. The supporting member 16 is mounted so as to be swingable about the supporting shaft 16*a*, and the charging roller 2 is urged in the direction of contacting to the photosensitive drum 1 by an unshown urging member.

Therefore, when the projection 20 rotates to act on the supporting member 16, the supporting member 16 is swung counterclockwise about the supporting shaft 16*a* in FIG. 5, to move the charging roller 2 in the direction of releasing the contact with the photosensitive drum 1.

On the other hand, as has been described hereinbefore, in this embodiment, the developing unit 4 is urged counterclockwise (the direction in which the developing roller 5 contacts the photosensitive drum 1) about the supporting shaft 11 by the spring 12 in FIG. 5.

FIG. 5 shows the state where the developing roller 5 and the photosensitive drum 1 contact each other along the longitudinal direction. The position of the developing unit 4 relative to the drum unit 8 in the state where the developing roller 5 and the photosensitive drum 1 contact each other along the longitudinal direction is called the "contact position."

FIG. 6 shows the state where the developing roller 5 and the photosensitive drum 1 are spaced from each other. The position of the developing unit 4 relative to the drum unit 8 in the state where the developing roller 5 and the photosensitive drum 1 are separated from each other, the position of the developing unit 4 relative to the drum unit 8 is called "spacing position."

The cam 19 includes a large diameter portion 191 and a small diameter portion 192. When the large diameter portion 191 takes an angular position opposed to the cam acting surface 15 of the developing unit 4, the large diameter portion 191 is contacted to the cam acting surface 15, and presses the cam acting surface 15 substantially horizontally. By this, the developing unit 4 is positioned at the spacing position and (FIG. 6), the developing roller 5, and the photosensitive drum 1 are spaced from each other. In FIG. 6, the amount of spacing is depicted by m. In this embodiment, the configuration of the cam 19 is selected so that the amount of spacing m may be of the degree of 1 mm.

In this embodiment, as shown in FIG. 3 (*b*), the end 14*a* of the cam shaft 14 is rotatably supported on the drum unit frame 81, and the free end portion thereof is provided integrally with a moving member driving force receptor portion 10 for moving the moving member 19. In this embodiment, the driving force receptor portion 10 is in the form of a cylindrical shaft portion 10*a*, and a notch or slot 10*b* is formed in the radial direction. Alternatively, the moving member driving force receptor portion 10 may be formed as a member separate from the cam shaft 14, and it may be connected operatively to the cam shaft 14 by the coupling means (unshown).

When the cartridge 7 is mounted to the main assembly 100A of the apparatus 100, a connection coupling of the photosensitive drum 1 is connected with the driving source 120 of the main assembly of the apparatus, and the driving force is transmitted. On the other hand, when the cartridge 7 is mounted to the main assembly 100A of the apparatus 100, the driving force receptor portion 10 of the cam shaft 14 is also connected with the drive transmitting portion 108 provided in the main assembly of the apparatus, and receives the driving force.

The driving force receptor portion 10 receives the driving force for rotating the cam 19 from the drive transmitting portion 108, so that the cam shaft 14 and the cam 19 (19*a*, 19*b*) rotate counterclockwise in FIG. 5. That is, the developing unit 4 rotates clockwise in FIG. 5 about the pivot pin 11 against the elastic force of the spring 12. The amount of spacing m becomes small gradually in accordance with the rotation of the developing unit 4.

And, the small diameter portion 192 opposes the cam acting surface 15. As a result, the developing unit 4 moves to the contact position from the spacing position (FIG. 5). In this state, the developing roller 5 and the photosensitive drum 1 contact each other. In other words, if the cam 19 rotates from the position where the large diameter portion 191 and the cam acting surface 15 are contacted to each other, through 180 degrees, the small diameter portion 192 comes to the position opposing the cam acting surface 15. As a result, the developing unit 4 moves to the contact position from the spacing position. When the developing unit 4 is in the contact position, the cam 19 is completely spaced from the cam acting surface 15.

In this embodiment, whenever the cam 19 rotates 180 degrees in the state in which the cartridge 7 is mounted to the main assembly 100A of the apparatus 100, the developing unit 4 moves between the contact position (FIG. 5) and the spacing position (FIG. 6) relative to the drum unit 8. In other words, the cam 19 is rotated in order to move the developing unit 4 between the contact position and the spacing position.

In this embodiment, as has been described hereinbefore, the outer periphery configuration of the cam 19 has a line symmetry configuration. By doing so, even if the rotational direction of the cam 19 is clockwise or counter-clockwise, the contact and the spacing operation between the developing roller 5 and the photosensitive drum 1 can be performed to the same timing.

The outer periphery configuration of the cam 19 is a smooth curve. By doing so, the possible influence on image formation by the shock of the contact and the spacing can be lessened. More particularly, when they are contacted to each other, the contact surface between the cam 19 and the cam acting surface 15 moves downwardly gradually along the curved surface of the cam 19 in accordance with the rotation of the cam 19 by the elastic force of the spring 12. Therefore, the vibration at the time of their contacting to each other is reduced.

(Protecting Cover)

In this embodiment, when shipping the cartridge 7 alone, the position of the cam 19 is retained in the state where the large diameter portion 191 is made to oppose the cam acting surface 15, and, in this state, the protecting cover 60 is mounted to the main assembly of the cartridge 7. By this, the photosensitive drum 1 is protected. According to this embodiment, as shown in FIG. 7, the protecting cover 60 of the photosensitive drum 1 covers the bottom surface of the main assembly of the cartridge 7, when it is mounted.

Figure 7:
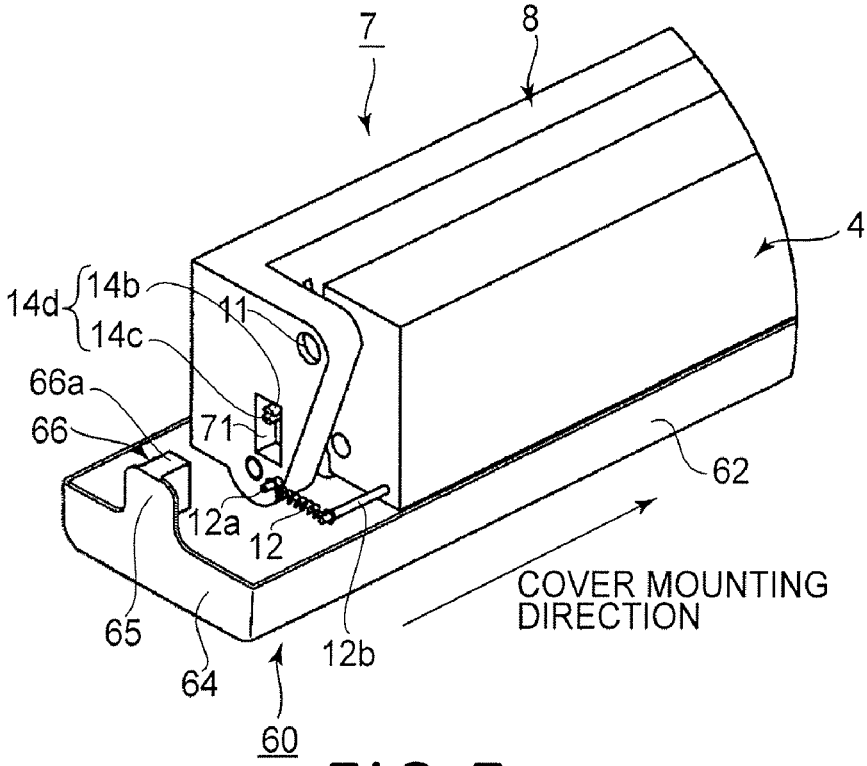
FIG. 7 is a perspective view showing attachment of a protecting cover according to an embodiment of the present invention.
Figure 8:
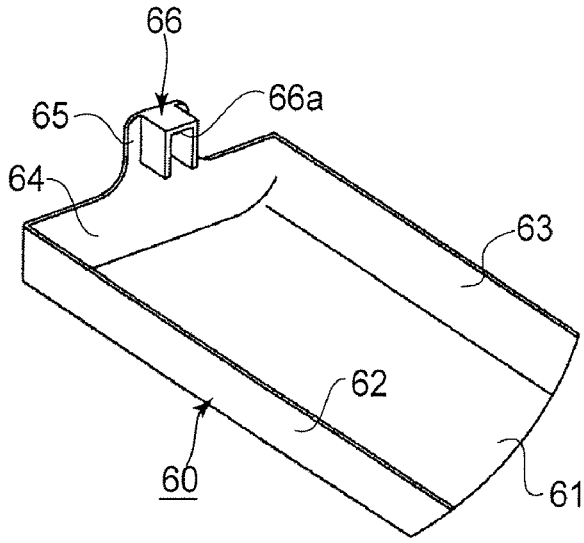
FIG. 8 is a detailed view of the protecting cover according to an embodiment of the present invention.
Figure 9:
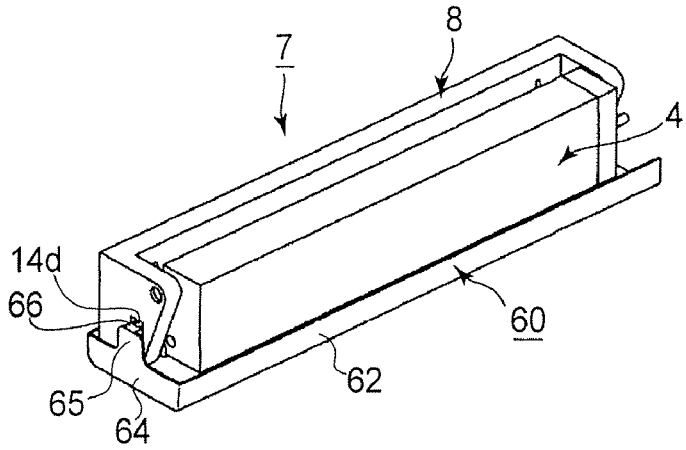
FIG. 9 is a perspective view showing the mount state of the protecting cover according to an embodiment of the present invention.

Referring to FIGS. 7-9, the protecting cover 60 of the photosensitive drum 1, and the rotation regulating structure of the cam shaft 14 will be described.

According to this embodiment, as shown in FIGS. 7-9, the protecting cover 60 of the photosensitive drum 1 is the container in the form of a tray in which the upper portion and the rear part are open. The protecting cover 60 comprises the bottom wall 61 of a rectangular shape, side walls 62, 63 which are in alignment with the longitudinal direction of the bottom wall 61, and the front wall 64. Before mounting the cartridge 7 to the main assembly 100A of the apparatus 100, the protecting cover 60 of this structure is mounted to the bottom portion of the main assembly of the cartridge 7, and covers the bottom surface of the main assembly of the cartridge 7.

A projection 65 projected upwards is formed on the front wall 64, and the locking portion 66 for regulating the rotation of the cam shaft 14 is provided inside of this projection 65.

On the other hand, the end 14*b* opposite from the driving force receptor portion 10 of the cam shaft 14 is supported on the drum frame 81. And, the free end thereof is exposed to the recess 71 formed at the side of the drum frame 81. The slot or groove 14*c* extended in the diameter direction is formed on the free end portion of the end 14*b*, and it is engageable with the locking portion 66 of the protecting cover 60.

In this embodiment, an end of the shaft portion 14*b* provided with the slot 14*c* functions, as will be described hereinafter, as the cam member rotation preventing member 14*d* which is the portion-to-be-locked engageable with the locking portion 66.

That is, in this embodiment, the locking portion 66 is a plate member and is a locking member in the form of a channel-shape rib which opens toward the lower side. Therefore, when the protecting cover 60 is mounted to the main assembly of the cartridge 7, the rib-like locking portion 66 having a channel like cross-section engages with the side recess 71 of the drum frame 81. By this, the upper plate (rib) 66*a* of the locking portion 66 engages with the slot 14*c*.

In this embodiment, a cam member rotation preventing member 14*d* is provided on the trailing side end with respect to the mounting direction of the cartridge 7. Therefore, when the structure that the protecting cover 60 separates from the main assembly of the cartridge 7 in interrelation with the mounting of the cartridge 7 to the main assembly of the apparatus is employed, the locking portion 66 of the protecting cover 60 does not obstruct the mounting operation of the cartridge 7.

In this embodiment, the driving force receptor portion 10 in which the slot 10*b* is formed may be a portion-to-be-locked. More particularly, the slot 10*b* has the structure similar to the end 14*b*. In this case, the protecting cover 60 is disposed so that the locking portion 66 opposes the driving force receptor portion 10. According to this type, since it is not necessary to provide the cam member rotation preventing member additionally, the object of this embodiment can be accomplished at low cost.

FIG. 9 is the perspective view showing the state when the protecting cover 60 in accordance with this embodiment is mounted to the main assembly of the cartridge 7.

In FIG. 9, the rib 66*a* of the locking portion 66 of the protecting cover 60 engages with the groove 14*c* of the cam member rotation preventing member 14*d*, and regulates the rotation of the cam shaft 14.

Thus, since the rotation of the cam shaft 14 is assuredly regulated at the times of inaction, such as the cartridge 7 shipment and transportation, the predetermined clearance can be assuredly maintained between the developing roller 5 and the photosensitive drum 1, and the developing roller 5 and the photosensitive drum 1 can be spaced from each other. Therefore, no dent or the like is produced in an elastic portion of the developing roller 5, and therefore, it is possible to produce good images at the time of the usage of the cartridge 7.

In addition, if the cam 19 rotates in response to the transfer of the driving force from the main assembly 100A of the apparatus 100 in the state in which it is mounted to the main assembly 100A of the apparatus 100 after the protecting cover 60 is removed from the main assembly of the cartridge 7, the developing unit 4 can be set to the contact position from the spacing position.

In this way, according to this embodiment, the deformation of the elastic member 51 which may be produced in the case of keeping it for a long term in the state in which the photosensitive drum 1 and the developing roller 5 are contacted to each other along the longitudinal direction can be suppressed.

As compared with the case where the cam 19 is disposed in main assembly 100A of the apparatus 100, the amount of displacement of the cam 19 at the time of moving the developing unit 4 between the contact position and the spacing position can be reduced by disposing the cam 19 in the inside of the frame (the main assembly) of the cartridge 7.

As has been described hereinbefore, the cam 19 is disposed in the region R (the neighborhood of the developing roller 5 and the photosensitive drum). By doing so, in determining the amount of spacing between the developing roller 5 and the photosensitive drum 1, the influence of the deformation, the tolerance, etc. of the frame of the cartridge 7 or the other parts can be reduced.

This embodiment has been described with the example of the cam 19 as the moving member. However, the moving member is not limited to the cam mechanism, and may be a crank mechanism for example, or the like. When the cam mechanism described in this embodiment is used, the required space can be made small.

In this embodiment, the force for moving the developing unit 4 to the spacing position from the contact position is the urging force which the cam 19 urges to the cam-acting surface 15. The force for moving the developing unit 4 to the contact position from the spacing position is the elastic force of the spring 12. However, the force for making it move may not be limited to the type of this embodiment, but they may be vice versa.

The force for making it move is the force produced in accordance with the movement of the moving member. More particularly, the structure by which the moving member moves the developing unit between the contact position and the spacing position is not limited to the combination of a cam and a spring. It will be satisfactory if the developing unit can be moved between the contact position and the spacing position correspondingly to the movement of the moving member. For example, the crank mechanism mentioned above may be used.

The structure of moving the developing unit 4 to the spacing position using the cam 19, and moving the developing unit 4 to the contact position using the spring 12 as in this embodiment can stabilize the amount of entering of the developing roller 5 relative to the photosensitive drum 1.

Figure 10:
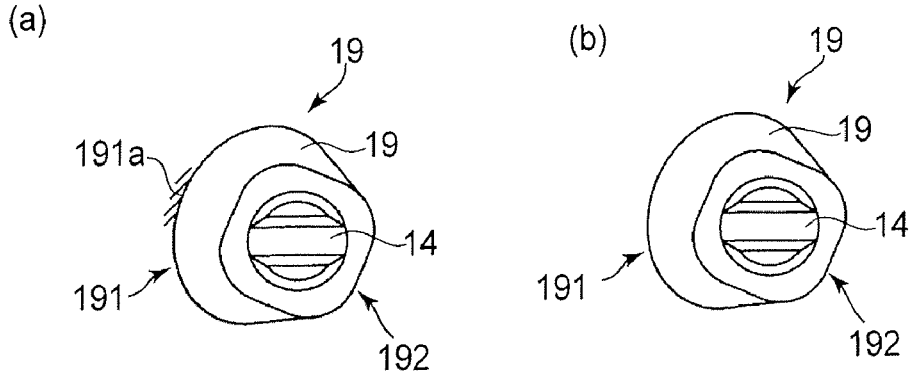
FIGS. 10(*a*) and 10(*b*) are detailed views of a cam shape according to an embodiment of the present invention.

When there is no locking portion 66 of the protecting cover 60, as shown in FIG. 10 (*a*), the flat surface portion 191*a* must be provided in the cam 19, disengagement of an urging portion must be avoided at the time of intact of the cartridge 7, and the spacing state must be retained. Therefore, the rotational load for overriding the flat surface portion 191*c* thereof is required in the case of the rotation of the cam shaft 14 at the time of switching between spacing and contact of the developing roller 5.

Since the rotation of the cam shaft 14 is regulated by the locking portion 66 of the protecting cover 60 with the structure of this embodiment, it is possible to smooth the urging portion of the cam 19 into the curved surface, as shown in FIG. 10 (*b*). Therefore, it is possible to reduce the rotational load at the time of the switching between spacing and contact of the developing roller 5.

In this way, according to this embodiment, the drive load of the main assembly of the apparatus can be reduced, the range of usable driving motors can be expanded, and a less expensive driving motor can be used.

In the above described embodiment, the cam member rotation preventing member 14*d* formed at a shaft end 14*b* of the cam shaft 14 has the helical groove configuration, and the locking portion 66 of the protecting cover 60 has a rib shape having a channel-like cross-section. However, the same effect can be acquired if it has the configuration capable of regulating the rotation. In the above described embodiment, although the protecting cover 60 protects the photosensitive drum 1, it may be an engaging member simply mounted on the main assembly of the cartridge 7 without protecting the photosensitive drum 1.

Figure 11:
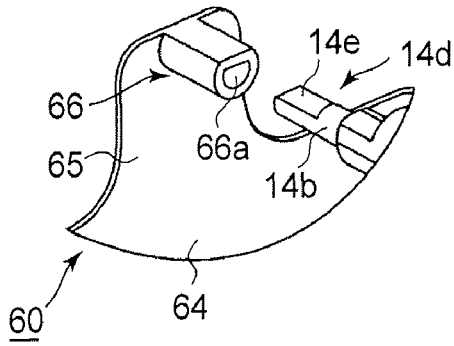
FIG. 11 is a detailed view showing another embodiment of a cam member rotation preventing member according to an embodiment of the present invention.

For example, as shown in FIG. 11, the shaft end 14*b* of the cam shaft 14 is formed into the shape of the letter D, as denoted by reference symbols 14*e*, as the cam member rotation preventing member 14*d*, and the locking portion 66 of the protecting cover 60 may be formed into a D-shaped hole 66*a*.

In this embodiment, the developing units 4 may be of other types and are not limited to the type of this embodiment. For example, the developing unit 4 may be of the structure supporting only the developing roller 5.

The process cartridge is not limited to the embodiment described above. For example, it is not necessary to have the cleaning member and the charging roller as the process means. More particularly, it may have an electrophotographic photosensitive member drum and a developing roller as the process means. While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 057624/2006 filed Mar. 3, 2006 which is hereby incorporated by reference.

What is claimed is:

1. A process cartridge detachably mountable to a main assembly of an electrophotographic image forming apparatus, comprising: an electrophotographic photosensitive member; a developing roller contactable to said electrophotographic photosensitive member to develop an electrostatic latent image formed on said electrophotographic photosensitive member; a photosensitive member unit supporting said electrophotographic photosensitive member so that a part of said electrophotographic photosensitive member is exposed; a developing unit supporting said developing roller and movable relative to said photosensitive member unit between a contact position for contacting said developing roller and said electrophotographic photosensitive member with each other to develop the electrostatic latent image and a spaced position for spacing said developing roller and said electrophotographic photosensitive member from each other; a movable member configured and positioned to transmit a driving force from said electrophotographic image forming apparatus for moving said developing unit between the contact position and the spaced position; and an engageable member configured and positioned to be engageable with said movable member to regulate movement of said movable member with said developing unit positioned in said spaced position.

2. A process cartridge according to claim 1, wherein one end of said movable member is exposed through an end surface of a main assembly of said process cartridge with respect to a longitudinal direction of said electrophotographic photosensitive member.

3. A process cartridge according to claim 1, wherein said engageable member is detachably mountable to a main assembly of said process cartridge.

4. A process cartridge according to claim 1, wherein said movable member is a rotatable cam member.

5. A process cartridge according to claim 1, wherein one end of said movable member is provided with a driving force receiving portion configured and positioned to receive the driving force from the main assembly of said apparatus, and the other end of said movable member is provided with a portion to be locked configured and positioned to be engageable with said engageable member for regulating movement of said movable member with said developing unit positioned in said spaced position.

6. A process cartridge according to claim 5, wherein said movable member transmits a driving force to said developing unit.

7. A process cartridge according to claim 6, wherein said movable member is a rotatable cam member.

8. A process cartridge according to claim 7, wherein said portion to be locked is engageable with an engageable member.

9. A process cartridge claim 5, wherein said engageable member is provided with a protection cover configured and positioned to cover said part to protect said electrophotographic photosensitive member.

10. A process cartridge according to claim 5, wherein said engageable member is detachably mountable to a main assembly of said process cartridge.

11. A process cartridge according to claim 10, wherein a mounting direction of said process cartridge relative to the main assembly of said apparatus is the same as a direction from the other end of said movable member toward said one end thereof, and wherein in interrelation with mounting of said process cartridge to the main assembly of said apparatus, engagement between said portion to be locked and said engageable member is released to permit separation between the main assembly of said process cartridge and said engageable member.

12. A process cartridge according to claim 1, wherein said movable member is provided with a driving force receiving portion that functions as a portion to be locked to be engageable with said engageable member for regulating movement of said movable member with said developing unit positioned in the spaced position.

13. A process cartridge according to claim 12, wherein said portion to be locked is engageable with an engageable member.

14. A process cartridge according to claim 12, wherein said engageable member is provided with a protection cover configured and positioned to cover said part to protect said electrophotographic photosensitive member.

15. A process cartridge according to claim 12, wherein said engageable member is detachably mountable to a main assembly of said process cartridge.

16. A process cartridge according to claim 1, wherein said engageable member is provided with a protection cover configured and positioned to cover said part to protect said electrophotographic photosensitive member.

17. A process cartridge according to claim 9, wherein a mounting direction of said process cartridge relative to the main assembly of the apparatus is the same as a direction from the other end of said movable member toward said one end thereof, and wherein in interrelation with mounting of said process cartridge to the main assembly of the apparatus, engagement between said portion to be locked and said engageable member is released to permit separation between the main assembly of said apparatus and said protection cover.

18. A process cartridge according to claim 12, wherein said movable member is a rotatable cam member.

* * * * *